United States Patent [19]

Nycz

[11] Patent Number: 4,763,801

[45] Date of Patent: Aug. 16, 1988

[54] CHILD-RESISTANT, TAMPER EVIDENT DISPENSING CLOSURE

[75] Inventor: Joseph D. Nycz, Haskins, Ohio

[73] Assignee: Owens-Illinois Closure Inc., Toledo, Ohio

[21] Appl. No.: 105,935

[22] Filed: Oct. 8, 1987

[51] Int. Cl.[4] ..... A61J 1/00; B65D 55/02

[52] U.S. Cl. ..... 215/203; 215/237; 215/235; 220/338; 222/153; 222/534

[58] Field of Search ..... 215/203, 206, 208, 235, 215/237; 220/338; 222/23, 153, 533, 534

[56] References Cited

U.S. PATENT DOCUMENTS

| | | | |
|---|---|---|---|
| 4,399,928 | 8/1983 | Klingler | 220/335 |
| 4,595,123 | 6/1986 | Libit | 222/153 |
| 4,632,266 | 12/1986 | Osswald | 215/235 |
| 4,711,363 | 12/1987 | Marino | 215/237 |

*Primary Examiner*—George T. Hall

[57] ABSTRACT

A dispensing closure for attachment to the finish of a bottle and a package which includes a bottle and such a dispensing closure attached to the finish thereof. The closure includes a molded plastic body portion with an irregular, generally horizontal top structure and a dispensing opening in such top structure, a pivotable member which is frictionally and pivotally attached to the top structure and which is pivotable in a vertical plane between a generally horizontal, closing position and an upright, open or dispensing position in which a dispensing passage in the pivotable member is aligned with the dispensing opening in the body portion. The closure also includes a dispensing control member which is rotatable in a horizontal plane with respect to the body portion, the dispensing control member having a horizontal disc with a slot therein, the disc being capable of rotation to bring the slot into alignment with the pivotable member to permit the pivotable member to be pivoted through the slot from the closing position to the open or dispensing portion.

22 Claims, 4 Drawing Sheets

CHILD-RESISTANT, TAMPER EVIDENT DISPENSING CLOSURE

BACKGROUND OF THE INVENTION

1. Field of the Invention

This invention relates to a dispensing closure which is adapted to be affixed to the exterior of the neck or finish portion of a bottle. More particularly, this invention relates to a dispensing closure which is provided with child-resistant opening characteristics. A dispensing closure according to the present invention may also be provided with tamper evident opening characteristics.

2. Description of the Prior Art

U.S. Pat. No. 4,595,123 (S. M. Libit), which is assigned to the assignee of this application, discloses a dispensing closure in which a dispensing orifice in the top of the closure is selectively opened or closed by a pivotable stopper which is carried in a socket in the top of the closure. Tamper evident opening characteristics are imparted to the closure of this reference by forming the stopper in the space between the legs of a U-shaped flange which is integrally molded with the stopper and which must be removed from the stopper before the stopper can be pivoted to its opened condition. The closure of this reference is complex and expensive, and it is difficult to open during the initial opening thereof. U.S. Pat. No. 4,533,058 (A. P. Uhlig), which is also assigned to the assignee of this application, also discloses a one-piece child-resistant dispensing closure which has a dispensing orifice in the top of the closure that is selectively opened or closed by a pivotable member.

U.S. Pat. No. 3,782,577 (J. Levey) discloses a dispensing closure which dispenses through a pivotable dispensing spout that is carried by the top of a closure, the dispensing spout being open for dispensing in a first position relative to the top of the closure and being closed to dispensing by the top of the closure in a second position relative to the top of the closure. Separate annular elements are provided to form a combination lock which prevents the movement of the dispensing spout to the dispensing position unless the annular elements are in proper orientation, but this construction is also complex and expensive, requiring separately formed annular elements for the proper operation thereof, and does not purport to have the characteristics needed to be tamper evident.

U.S. Pat. Nos. 3,884,392 (R. E. Hazard), 4,047,643 (R. E. Hazard) and 4,081,113 (R. E. Hazard) also disclose dispensing closures each of which dispenses through a pivotable dispensing spout, and while the closures of these references appear to have child-resistant opening characteristics, they do not appear to have tamper evident opening characteristics.

SUMMARY OF THE INVENTION

According to the present invention, there is provided a turret type dispensing closure which has child-resistant opening characteristics and which can be provided with tamper evident opening characteristics. The closure according to the present invention is made up of three components, each of which can be produced from a thermoplastic material to minimize the cost of such closure. The first of such components is a main closure body portion which is adapted to be affixed to the neck or finish of a bottle and which includes a dispensing opening in a top portion thereof. The second of such components is a pivotable member which is frictionally engaged within a socket of the main closure body and which is pivotable in such socket with respect to the main closure body portion to selectively open the dispensing opening therein for dispensing or close such dispensing opening to dispensing. The third of such components is a horizontal dispensing control disc with a radial slot for the pivoting of the pivotable member therethrough. This disc is engaged within a recess in the main closure body above the plane of the pivotable member when the pivotable member is in its closing position, and is rotatable within such recess about a horizontal axis to selectively align or misalign the slot in the disc with respect to the pivotable member to permit the pivotable member to be rotated to its dispensing position when the slot and the pivotable member are aligned, and to retain the pivotable member in a closed position when the slot in the disc is not in alignment therewith. Thus, the manipulation of the disc which is required to bring the slot therein into alignment with the pivotable member, in conjunction with a ratchet type of threaded engagement between the closure and the bottle to which it is affixed to make the removal of the closure from the bottle extremely difficult, imparts child-resistant opening characteristics to such closure. Further, tamper evident opening characteristics may be imparted to such closure by incorporating an integral bridge across the slot in the horizontal dispensing control disc which must be broken away by the first pivoting of the pivotable member to its dispensing position, to thereby provide a visible indication that the package has been opened or that it has experienced an opening attempt.

The present invention can be applied to a dispensing closure of the type which dispenses through a passage in the pivotal member which acts as a spout, when the pivotable member is in a position where such passage is in fluid communication with an opening in the closure body, and it can also be applied to a dispensing closure of the type which dispenses directly through an opening in the main closure body, which opening is closed by a projection that is carried by the pivotable member when the pivotable member is in its closing position.

Accordingly, it is an object of the present invention to provide a novel, tamper evident, turret type dispensing closure, and it is a further object of the present invention to provide a package which includes a bottle with a tamper evident, turret type dispensing closure affixed thereto.

It is also an object of the present invention to provide a novel, tamper evident, turret type dispensing closure which has child-resistant opening characteristics, and it is also an object of the present invention to provide a package which includes a bottle and a tamper evident, turret type, child-resistant dispensing closure affixed thereto.

For further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1:
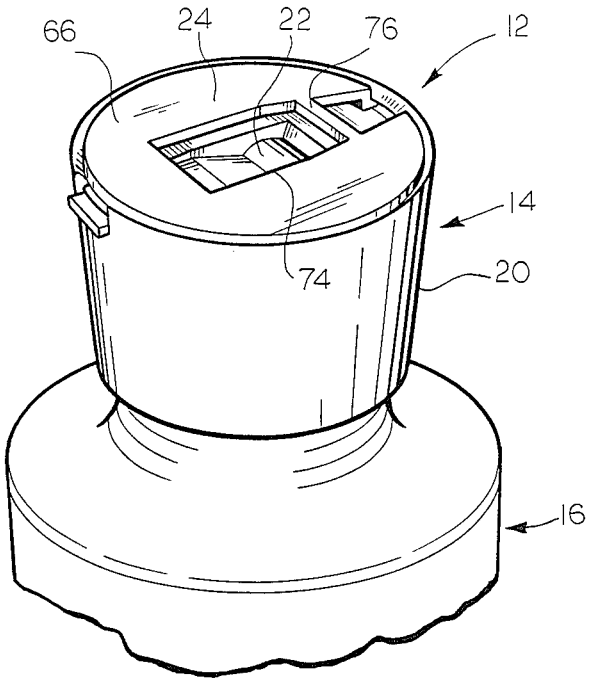
FIG. 1 is a fragmentary perspective view of a package which incorporates a dispensing closure according to the present invention in assembled relationship to a bottle, the package being in a condition where it cannot be opened without special manipulation of such closure.
Figure 2:
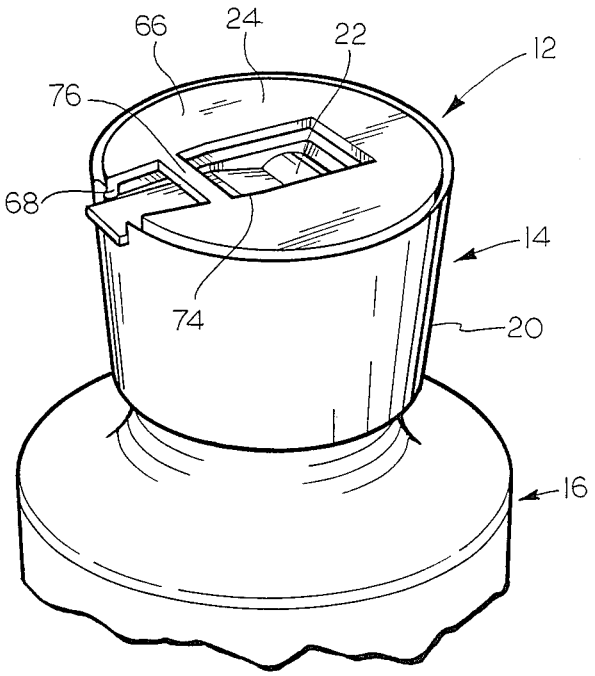
FIG. 2 is a view similar to FIG. 1 in which the closure has been manipulated so that the package is in condition for opening.
Figure 3:
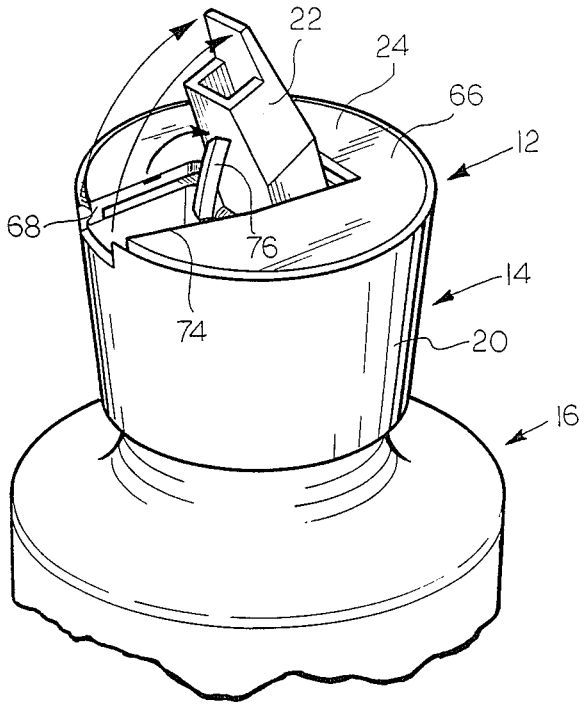
FIG. 3 is a view similar to FIG. 1 and 2 in which the package has been opened for dispensing.
Figure 8:
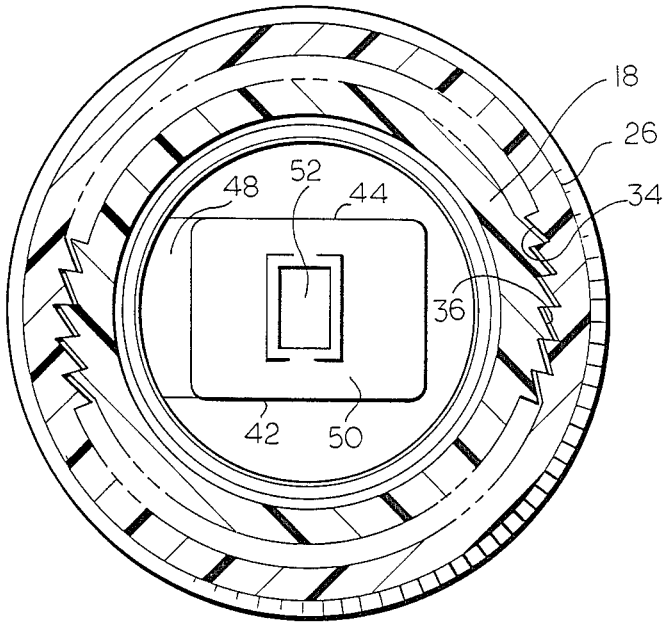
FIG. 8 is a sectional view taken on line 8—8 of FIG. 5.
Figure 4:
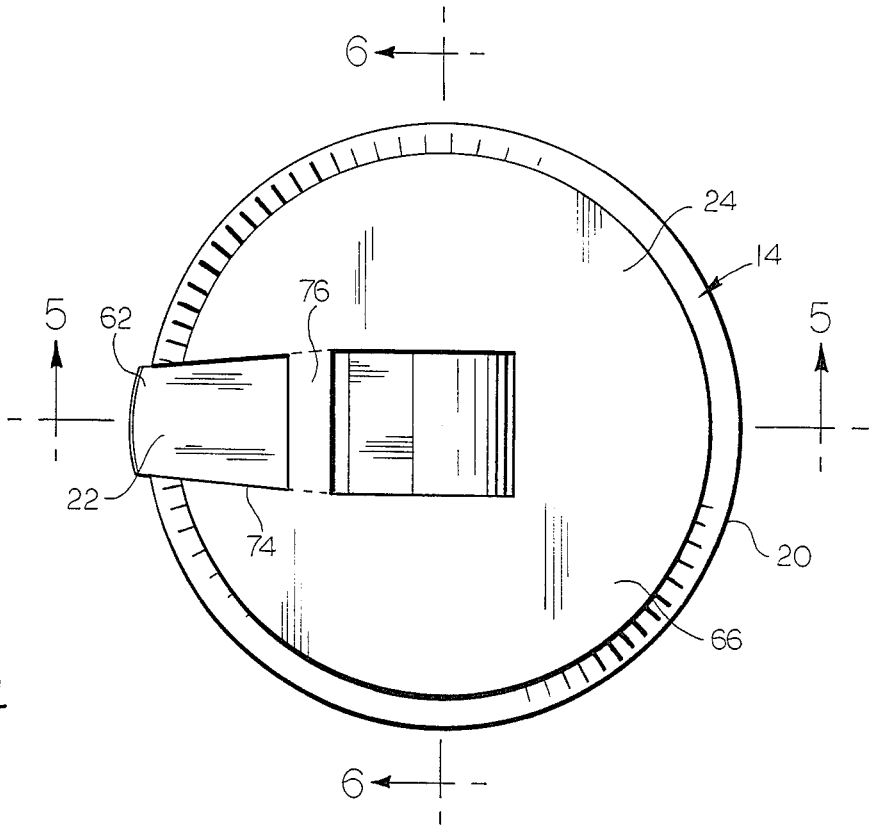
FIG. 4 is a plan view of the package of FIGS. 1 through 3 in the FIG. 2 condition of such package.

As is shown in FIGS. 1, 2 and 3, a package in accordance with the present invention is indicated generally by reference numeral 12, and the package 12 is made up of a closure which is generally identified by reference numeral 14 and which is affixed to the finish 18 of a bottle which is generally identified by reference numeral 16 and which is shown fragmentarily. The bottle 16 may be a blown glass container or it may be a blow-molded plastic container, for example, a blow-molded, high density polyethylene container.

The closure 14 includes a main body portion 20, a pivotable dispensing spout 22 and a dispensing control disc 24, each of which can be readily and relatively inexpensively produced from a suitable thermoplastic material, for example, one comprised mainly of high density polyethylene or polypropylene, by injection molding, and which are frictionally assembled together as will be hereinafter described more fully.

The main body portion 20 of the closure 14, which is integrally formed in a single piece, is made up of an annular skirt 26 and a generally horizontally extending top structure 28 which is contained within the annulus that is defined by the annular skirt 26. The annular skirt 26 is provided with an inwardly projecting helical thread 30 which engages a corresponding outwardly projecting helical thread on the finish 18 of the bottle 16, whereby the closure 14 may be applied to the bottle 16 by a screwing on action. Further, the annular skirt 26 of the main body portion 26 of the closure 14 is provided with a circumferential series of inwardly projecting, inclined ratchet teeth 34 which engage a corresponding circumferential series of outwardly projecting, inclined ratchet teeth 36 on the finish 18 of the bottle 16 when the closure 14 is fully screwed onto the finish 18 of the bottle 16. The ratchet teeth 34 and 36 are all inclined in the direction of the application of the closure 14 on the finish 18 on the bottle 16 and, thus, are inclined away from the direction of removal of the closure 14 from the finish 18 of the bottle 16. By virtue of this arrangement of the ratchet teeth 34 and 36, it will require considerably more torque to remove the closure 14 from the bottle 16 than was required for the original application of the closure 14 to the bottle 16, thus helping to safeguard against the removal of the closure 14 of the bottle 16 accidentally, inadvertently, or by a child.

The main body portion 20 of the closure 14 is also provided with wall means 38 defining a recess 40, which is below the elevation of the top structure 28 and which extends from an interior portion of the main body portion 20 radially outwardly to a marginal portion thereof. The wall means 38 includes spaced-apart sidewalls 42 and 44 which depend downwardly from the top structure 28 and a bottom wall 48, which has a part cylindrical portion 50 and which extends between the sidewalls 42 and 44, the part cylindrical portion 50 of the bottom wall 48 being provided with a dispensing opening 52 along a radius of such part cylindrical portion thereof, and preferably at the bottom thereof. Thus, the sidewalls 42 and 44 and the part cylindrical portion 50 of the bottom wall 48 define a part cylindrical socket 54 and the arcuate extent of the part cylindrical socket 54 is preferably a little greater than 180 degrees to frictionally retain a part cylindrical end portion 56 of the pivotable dispensing spout 22, which is pivotably received in the part cylindrical socket 54.

Figure 7:
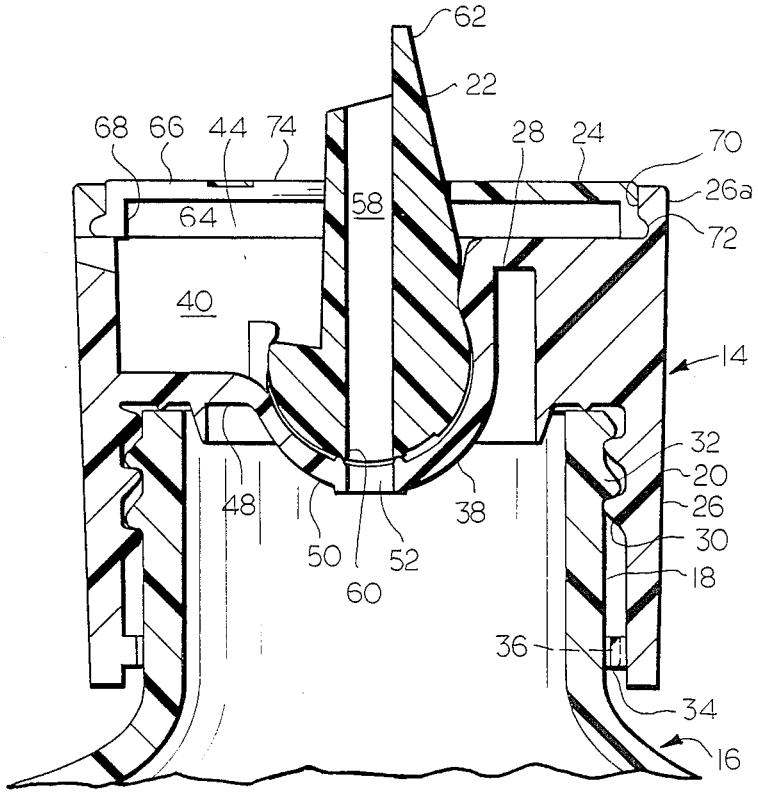
FIG. 7 is a sectional view similar to FIG. 5 but in the FIG. 3, opened condition of such package.

The pivotable dispensing spout 22 is provided with a dispensing passage 58, which is aligned with a radius of the part cylindrically portion 56 of the pivotable dispensing spout 22 and which permits the dispensing of the contents of the bottle 16 through the closure 14 when the pivotable dispensing spout 22 is pivoted with respect to the main body portion 20 to bring the dispensing passage 58 in the pivotable dispensing spout 22 into alignment with the dispensing opening 50 in the main body portion 20, as is shown in FIG. 7 of the drawing. Further, sealing engagement is maintained between the inside surface of the part cylindrical socket 54 of the main body portion 20 and the outside surface of the part cylindrical end of portion 56 of pivotable dispensing spout 22, for example, by providing the part cylindrical socket 54 with an annular sealing rib 60, which surrounds the dispensing opening 52 and which sealingly engages the outside surface of the part cylindrical end portion 56, thus precluding the dispensing of the contents of the bottle 16 through the closure 14 when the pivotable dispensing spout 22 is pivoted with respect to the main body portion 20 so that the dispensing passage 58 is out of alignment with the dispensing opening 50, as is shown in FIG. 5 of the drawing.

Figure 5:
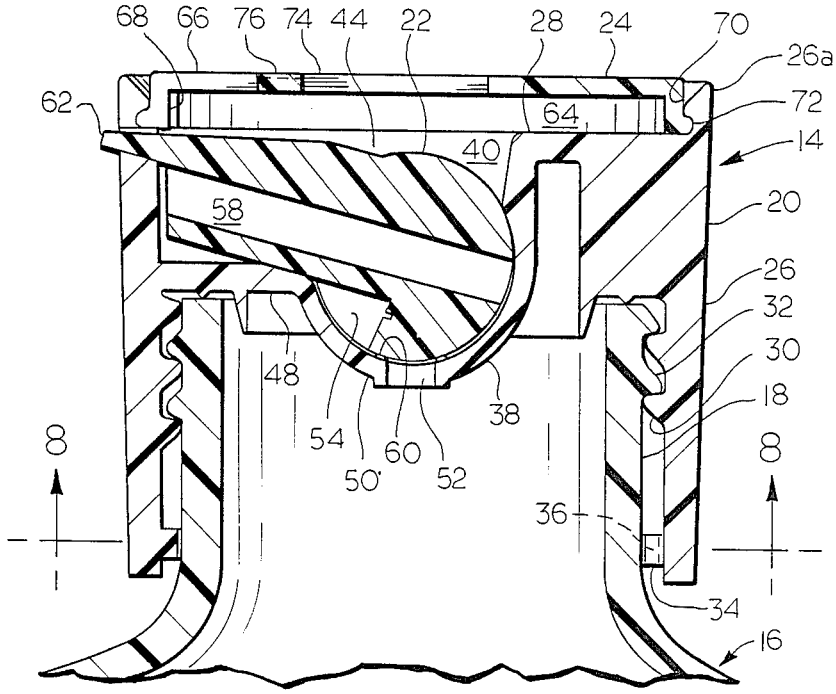
FIG. 5 is a sectional view taken on line 5—5 of FIG. 4.
Figure 6:
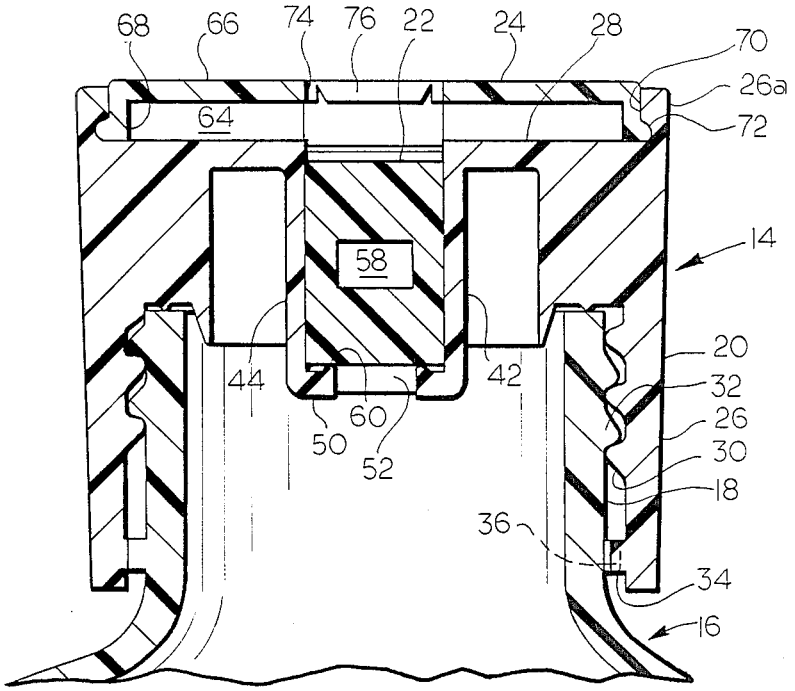
FIG. 6 is a sectional view taken on line 6—6 of FIG. 4.

The depth of the recess 40 of the main body portion 20 of the closure 14 is sufficient to permit all portions of the pivotable dispensing spout 22 to be pivoted to a generally horizontally extending position at an elevation which is below that of the top structure 28, as is shown in FIG. 5, the pivotal dispensing spout 22 being provided with a tip portion 62 which extends beyond the outside of the annular skirt 26 of the main body portion 20 when the pivotable dispensing spout 22 is in the FIG. 5, closed position, to permit manual engagement of the pivotable spout 22 in all of its positions. Thus, when the pivotable dispensing spout is in its FIG. 5, closed position, an empty space 64 is formed above the elevation of the top structure 28, and the empty space 64 is surrounded by an extension 26*a* of the annular skirt 26 of the main body portion 20 which extends above the level of the top structure 28 thereof.

The dispensing control disc 24 has a horizontally extending top portion 66 and a downwardly extending annular skirt 68 which is positioned in overlapping, concentric relationship with the extension 26*a* of the annular skirt 26 of the main body portion 20, the annular skirt 66 being positioned radially inwardly of the extension 26*a*. The annular skirt 68 of the dispensing control disc 24 and the extension 26*a* of the annular skirt 26 of the main body portion 20 are each circular in configuration; thus, the dispensing control disc 24 is rotatable with respect to the main body portion 20, and it is frictionally retained in such rotatable engagement by means of an interference snap fit between an inwardly projecting bead 70 at the top of the extension 26*a* of the annular skirt 26 and an outwardly projecting bead 72 at the bottom of the annular skirt 68 of the dispensing disc control 24. The dispensing control disc 24 is provided with a radially extending slot 74 in the top portion 66 thereof, and the radial slot 74 is adapted to be positioned, by the rotation of the dispensing control 24 with respect to the main body portion 20, into a position in alignment with the pivoting motion of the pivotable dispensing spout 22, whereby the pivotable dispensing spout 22 can be pivoted through the slot 74 from the closed position, as shown in FIGS. 1, 2, 4, 5 and 6, into the dispensing position, as shown in FIGS. 3 and 7. The manipulation required to properly orient the dispensing control disc 24 with respect to the main body portion 20 so that the radial slot 74 is in alignment with the pivoting of the pivotal dispensing spout 22 is a type of manipulation which, while not presenting undue difficulty to an adult, especially if suitable opening instructions are embossed into or printed on the top surface of the top portion 66 of the dispensing control disc 24, nevertheless imparts significant resistance to opening of the package 12 by a child. Further, the manipulation of the dispensing control disc 24 with respect to the body portion does not require high levels of torque and does not, therefore, pose undue opening difficulties so the elderly for impaired adults. To impart tamper evident opening characteristics to the package 12, the top portion 66 of the dispensing control disc 24 is provided with a frangible bridge member 76 extending across the slot 74 in the top portion 66, and the bridge member 76, thus, must be broken away from the top portion 66 before the pivotable dispensing spout 22 can be pivoted from the FIG. 5, closed condition to the FIG. 7, dispensing condition. This breaking away of the bridge member 76 upon the first opening of the package 12, thus, provides a visually detectable indication to a consumer or to a retail store employee of a prior opening or attempted opening of the package 12, and of the possible tampering with the contents of the package 12.

While the use of a rotatable, dispensing control disc has been described in connection with a dispensing closure which dispenses through a pivotable dispensing spout, it is also contemplated that this feature can be utilized with a dispensing closure of the type in which the contents of the bottle to which such closure is affixed are dispensed directly through an opening in the top of the closure, which opening is selectively opened or closed by a pivoting member which does not, itself, have a dispensing passage extending therethrough, for example, with a closure of the type illustrated in the aforesaid U.S. Pat. No. 4,533,058.

This invention, and the manner and process of making it and using it, have been described above in terms sufficiently full, clear, concise and exact as to enable any person skilled in the art to make and use the same, and the best mode contemplated by the inventor for carrying out this invention has been set forth. It is to be understood, however, that it is contemplated that certain modifications of the above invention and/or best mode for carrying out the invention can be made by a skilled artisan without departing from the scope of the invention and it is, therefore, desired to limit the invention only in accordance with the appended claims:

I claim:

1. A dispensing closure for a bottle that contains a flowable product, the bottle having an annular closure receiving finish, said closure comprising:

a body portion having an annular skirt with bottle finish engaging means, said annular skirt being adapted to surround and engage the finish of the bottle, said body portion further having generally horizontally extending top structure means positioned within an annulus defined by said annular skirt and a dispensing opening within said top structure means, said annular skirt having a portion which projects above said top structure means;

dispensing control means comprising a generally horizontally extending disc, said generally horizontally extending disc cooperating with said portion of said annular skirt and said top structure to define a space, said generally horizontally extending disc having slot means therein and being rotatable about a vertical axis with respect to said body portion; and pivotable means, said pivotable means being pivotable about a horizontal axis with respect to said body portion between a first position in which said pivotable means closes said dispensing opening within said top structure means and does not extend above said space and a second position in which said pivotable means opens said dispensing opening of said top structure to permit dispensing of the flowable product in the bottle through said closure, said pivotable means comprising a portion which extends above said space when said pivotable means is in said second position, said slot means of said disc being adapted to be in alignment with said pivotable means when said pivotable means is in said first position and said disc is in a first orientation with respect to said body portion whereby said pivotable means can be pivoted to said second position through said slot means, said disc being rotatable to a second orientation with respect to said body portion in which said slot means is not in alignment with said pivotable means, whereby said disc blocks the pivoting of said pivotable means from said first position to said second position when said disc is in said second orientation with respect to said body portion.

2. A dispensing closure according to claim 1 wherein said pivotable means further comprises a part cylindrical end portion and wherein said generally horizontally extending top structure comprises wall means defining a part cylindrical socket portion, said part cylindrical end portion of said pivotable means being pivotably received in said part cylindrical socket portion of said generally horizontally extending top structure.

3. A dispensing closure according to claim 2 wherein said pivotable means comprises a dispensing passage extending therethrough, wherein said dispensing opening in said top structure means is in said part cylindrical socket portion, wherein said dispensing passage is aligned with said dispensing opening when said pivotable means is in said second position, and wherein said dispensing passage is not aligned with said dispensing opening when said pivotable means is in said first position.

4. A dispensing closure according to claim 2 wherein said part cylindrical end portion of said pivotable means has an arcuate extent of more than 180 degrees, wherein said part cylindrical socket portion of said top structure has an arcuate extent of more than 180 degrees, and wherein said part cylindrical end portion is frictionally retained within said part cylindrical socket portion.

5. A dispensing closure according to claim 1 wherein said portion of said pivotable means extends radially outwardly of said annular skirt of said body portion when said pivotable means is in said first position with respect to said body portion to permit said pivotable means to be manually moved from said first position to said second position.

6. A dispensing closure according to claim 1 wherein said dispensing control means further comprises an annular skirt, said annular skirt of said dispensing control means being concentrically positioned with respect to said portion of said annular skirt of said body portion.

7. A dispensing closure according to claim 6 wherein said annular skirt of said dispensing control means is positioned radially inwardly of said portion of said annular skirt of said body portion.

8. A dispensing closure according to claim 7 wherein said annular skirt of said dispensing control means is circular in configuration and has radially outwardly projecting bead means, and wherein said portion of said annular skirt of said body portion is circular in configuration and has radially inwardly projecting bead means, said radially outwardly projecting bead means and said radially inwardly projecting bead means forming an interference snap fit between said dispensing control means and said body portion to prevent the disassociation of said dispensing control means from said body portion.

9. A dispensing closure according to claim 1 wherein said dispensing control means further comprises frangible bridge means extending across said slot means in said horizontally extending disc, said frangible bridge means being subject to being broken away from said horizontally extending disc upon the initial movement of said pivotable means from said first position to said second position to provide said closure with tamper evident opening characteristics.

10. A dispensing closure according to claim 1 wherein said body portion is molded integrally in a first single piece from a first thermoplastic material, wherein said dispensing control means is molded integrally in a second single piece from a second thermoplastic material, and wherein said pivotable means is molded integrally in a third single piece from a third thermoplastic material.

11. A dispensing closure according to claim 3 wherein said part cylindrical socket portion of said top structure further comprises annular sealing fin means surrounding said dispensing opening, said annular sealing fin means sealingly engaging said part cylindrical end portion of said pivotable means to confine the dispensing of the flowable product from the container to said dispensing passage by way of said dispensing opening.

12. A package comprising:

a bottle having an annular finish and closure engaging means, said bottle being adapted to contain a flowable product, and a closure, said closure having an annular skirt with bottle finish engaging means, said annular skirt surrounding and engaging the finish of the bottle, said body portion further having generally horizontally extending top structure means positioned within an annulus defined by said annular skirt and a dispensing opening within said top structure means, said annular skirt having a portion which projects above said top structure means;

dispensing control means comprising a generally horizontally extending disc, said generally horizontally extending disc cooperating with said portion of said annular skirt and said top structure to define a space, said generally horizontally extending disc having slot means therein and being rotatable about a vertical axis with respect to said body portion; and pivotable means, said pivotable means being pivotable about a horizontal axis with respect to said body portion between a first position in which said pivotable means closes said dispensing opening within said top structure means and does not extend above said space and a second position in which said pivotable means opens said dispensing opening of said top structure to permit dispensing of the flowable product in said bottle through said closure, said pivotable means comprising a portion which extends above said space when said pivotable means is in said second position, said slot means of said disc being adapted to be in alignment with said pivotable means when said pivotable means is in said first position and said disc is in a first orientation with respect to said body portion whereby said pivotable means can be pivoted to said second position through said slot means, said disc being rotatable to a second orientation with respect to said body portion in which said slot means is not in alignment with said pivotable means, whereby said disc blocks the pivoting of said pivotable means from said first position to said second position when said disc is in said second orientation with respect to said body portion.

13. A package according to claim 12 wherein said pivotable means of said dispensing closure further comprises a part cylindrical end portion and wherein said generally horizontally extending top structure comprises wall means defining a part cylindrical socket portion, said part cylindrical end portion of said pivotable means being pivotably received in said part cylindrical socket portion of said generally horizontally extending top structure.

14. A package according to claim 13 wherein said pivotable means of said closure comprises a dispensing passage extending therethrough, wherein said dispensing opening in said top structure means of said body portion of said closure is in said part cylindrical socket portion, wherein said dispensing passage is aligned with said dispensing opening when said pivotable means is in said second position, and wherein said dispensing passage is not aligned with said dispensing opening when said pivotable means is in said first position.

15. A package according to claim 13 wherein said part cylindrical end portion of said pivotable means of said closure has an arcuate extent of more than 180 degrees, wherein said part cylindrical socket portion of said top structure has an arcuate extent of more than 180 degrees, and wherein said part cylindrical end portion is frictionally retained within said part cylindrical socket portion.

16. A package according to claim 12 wherein said portion of said pivotable means of said closure extends radially outwardly of said annular skirt of said body portion when said pivotable means is in said first position with respect to said body portion to permit said pivotable means to be manually moved from said first position to said second position.

17. A package according to claim 12 wherein said dispensing control means of said closure further comprises an annular skirt, said annular skirt of said dispensing control means being concentrically positioned with respect to said portion of said annular skirt of said body portion of said closure.

18. A package according to claim 17 wherein said annular skirt of said dispensing control means of said closure is positioned radially inwardly of said portion of said annular skirt of said body portion of said closure.

19. A package according to claim 18 wherein said annular skirt of said dispensing control means of said closure is circular in configuration and has radially outwardly projecting bead means, and wherein said portion of said annular skirt of said body portion of said closure is circular in configuration and has radially inwardly projecting bead means, said radially outwardly projecting bead means and said radially inwardly projecting bead means forming an interference snap fit between said dispensing control means and said body portion to prevent the disassociation of said dispensing control means from said body portion.

20. A package according to claim 12 wherein said dispensing control means of said closure further comprises frangible bridge means extending across said slot means in said horizontally extending disc, said frangible bridge means being subject to being broken away from said horizontally extending disc upon the initial movement of said pivotable means from said first position to said second position to provide said closure with tamper evident opening characteristics.

21. A package according to claim 12 wherein said body portion of said closure is molded integrally in a first single piece from a first thermoplastic material, wherein said dispensing control means of said closure is molded integrally in a second single piece from a second thermoplastic material, and wherein said pivotable means of said closure is molded integrally in a third single piece from a third thermoplastic material.

22. A package according to claim 14 wherein said part cylindrical socket portion of said top structure of said body portion of said closure further comprises annular sealing fin means surrounding said dispensing opening, said annular sealing fin means sealingly engaging said part cylindrical end portion of said pivotable means of said closure to confine the dispensing of the flowable product from said container to said dispensing package by way of said dispensing opening.

* * * * *